US005894931A

United States Patent [19]

Dunn

[11] Patent Number: 5,894,931

[45] Date of Patent: Apr. 20, 1999

[54] BROCHURE DISPLAY WITH SPRING

[76] Inventor: Gary D. Dunn, 2368 Podocarpus Way, Clearwater, Fla. 34619

[21] Appl. No.: 08/948,649

[22] Filed: Oct. 10, 1997

[51] Int. Cl.[6] ..... B65D 43/16; A47F 3/00

[52] U.S. Cl. ..... 206/555; 221/59; 312/50; 312/123; 312/248

[58] Field of Search ..... 206/449, 555, 206/556; 312/50, 246, 248, 120, 245, 123; 221/45, 58, 59, 60, 26

[56] References Cited

U.S. PATENT DOCUMENTS

| | | | |
|---|---|---|---|
| 189,936 | 4/1877 | Herbert et al. | 312/120 |
| 282,785 | 8/1883 | Schoof | 221/59 X |
| 501,279 | 7/1893 | Knight . | |
| 544,588 | 8/1895 | Pattiani | 312/50 |
| 710,440 | 10/1902 | Dickinson | 312/248 X |
| 922,272 | 5/1909 | Garrod . | |
| 957,539 | 5/1910 | Berkebile | 221/26 |
| 1,155,791 | 10/1915 | Cabell . | |
| 1,312,385 | 8/1919 | Cahill | 312/50 |
| 1,441,410 | 1/1923 | Eustis | 312/50 X |
| 1,736,384 | 11/1929 | Wright | 206/555 X |
| 3,302,774 | 2/1967 | Zalkind . | |
| 3,632,017 | 1/1972 | Matthews | 206/449 X |
| 4,708,409 | 11/1987 | Voegeli | 312/138.1 |
| 4,726,634 | 2/1988 | Dewees et al. | 312/100 |
| 5,513,746 | 5/1996 | Anderson | 206/555 X |
| 5,800,027 | 9/1998 | Dunn | 312/120 X |

*Primary Examiner*—Bryon P. Gehman
*Attorney, Agent, or Firm*—Terrance L. Siemens

[57] ABSTRACT

A display for displaying and dispensing brochures. The display comprises a housing and a transparent door hinged to the housing to swing forwardly when opened. A pocket is pivotally mounted to the same hinge as that pivotally supporting the door. The pocket has a rear panel including a relief, or cut away section, enabling a person to grasp brochures stored in the pocket. A spring is attached to the pin of the hinge, to the door, and to the pocket such that the door is biased into the closed position and the pocket is biased against the door. The door is hinged at the bottom, and has a forwardly turned handle at the top for opening. The housing has an outwardly projecting flange extending along the entirety of the front opening of the housing, and a drip hood. The floor or bottom wall of the housing inclines to promote drainage. In a preferred embodiment, the door and pocket are molded integrally from an elastic material enabling the pocket to be opened elastically.

11 Claims, 2 Drawing Sheets

BROCHURE DISPLAY WITH SPRING

BACKGROUND OF THE INVENTION

1. Field of the Invention

The present invention relates to receptacles for displaying and dispensing papers, such as advertising circulars. The receptacle is to be mounted to a fixed surface and remains in place so that members of the public passing by the receptacle may take copies of the papers or the like made available. Merchants of all sorts will benefit from the invention, since their services and wares will be readily advertised at diverse locations proximate foot traffic.

2. Description of the Prior Art

Sales circulars, brochures, and similar promotional literature is widely employed to advertise services and wares. Such literature is made available in many ways, such as by direct mailings, hiring individuals to hand out the literature to passers by encountered on foot, by placing the literature on motor vehicles in parking lots, and by depositing the literature in receptacles in stores and other structures exposed to the public.

Direct mailings and hiring individuals entail considerable costs, especially when undertaken on large scale. Passing out literature on motor vehicles both requires manpower, and also risks creating a public nuisance, in that owners of the vehicles may carelessly discard the literature immediately, thereby littering the parking lot. Beyond the forementioned drawbacks, there is no assurance that the literature is being distributed to persons who are actually interested in the information being conveyed by the literature.

Many receptacles for dispensing literature and papers have been proposed in the prior art. Examples are seen in U.S. Pat. No. 501,279, issued to Richard D. Knight on Jul. 11, 1893, U.S. Pat. No. 922,272, issued to Frederick J. Garrod on May 18, 1909, U.S. Pat. No. 1,155,791, issued to John L. Cabell on Oct. 5, 1915, and U.S. Pat. No. 3,302,774, issued to Joseph Zalkind on Feb. 7, 1967. The subject devices of these patents illustrate boxes, that is, receptacles which are parallelepipeds having openable closures.

Knight and Zalkind illustrate closures providing doors hinged to swing away from the parallelepiped to reveal contents. Knight utilizes otherwise idle ends of the side walls to promote retention of the door in the closed position. The present invention has a spring urging the door closed, but the spring of the present invention is a coil spring arranged to exert force urging the door to swing back to the closed position. By contrast, the ends of the side walls in Knight resiliently hold the door closed by friction once manually placed in the closed position.

None of the prior art inventions cited show a full front flange and weather hood, nor interior pocket carried with the door, both being shown in the novel brochure holder. Also, none of these prior art patents shows a downwardly turned handle spaced apart from the front panel of the hinged door, a floor inclined to promote drainage of rain and the like, and a spring biased rear panel forming the rear wall of the pocket, the rear panel acting to hold displayed brochures in an upright position, the rear panel having a relief to afford ready finger access to the brochures.

None of the above inventions and patents, taken either singly or in combination, is seen to describe the instant invention as claimed.

SUMMARY OF THE INVENTION

The present invention provides a receptacle for displaying brochures and similar promotional literature. The novel brochure display may be mounted either inside buildings and protected areas, or unprotected outdoors. For mounting, it requires only a vertical environmental surface which can receive fasteners.

The novel brochure display has a housing open at the front and a hinged door spring biased to close the housing. The door has a downwardly turned handle enabling ready grasping and opening. Structure of this handle provides inherent intuitive suggestion as to how the brochure display is to be opened. The door readily opens against its spring, and spontaneously returns to the closed position when released by the user.

The hinged door has a pocket located inside the door, the pocket being spring biased to remain with the door when the door is opened. Brochures are carried within the pocket, and thus are more exposed to the user than would be the case if they were merely stacked within the housing. The rear panel of the pocket has a relief to enable ready grasp of brochures by finger. Spring action bearing on the pocket also supports brochures in an erect position, so that when the door is closed, the front page of the brochure is readily viewed through the transparent door. The transparent door enables passers by to view the brochures without going to the trouble of opening the display. This arrangement has a tendency to assure that brochures will be distributed to those having an actual interest in the displayed literature.

The door has an integral front flange and short drip hood, so that paper brochures receive a measure of protection against rain. The floor of the housing is inclined to promote drainage should rain, dust, or other contaminants enter the same.

Accordingly, it is a principal object of the invention to provide a brochure display enabling ready retrieval of displayed brochures.

It is another object of the invention that the brochure display be suitable for mounting in locations unprotected from the weather.

It is a further object of the invention that the brochure display have an exterior handle both affording ready grasp for opening and also intuitively suggesting how access to the interior of the display is gained.

Still another object of the invention is that brochures be carried on the door, so as to be more accessible than would be the case if they were merely stacked inside the display.

An additional object of the invention is that the door close spontaneously.

It is again an object of the invention to configure the display to afford protection against rain and other wind borne contaminants to the interior of the display.

Yet another object of the invention is the brochures be supported erect within the display, and that ready finger grasp of the brochures be afforded.

It is an object of the invention to provide improved elements and arrangements thereof in an apparatus for the purposes described which is inexpensive, dependable and fully effective in accomplishing its intended purposes.

It is also an object of the invention to provide a brochure holder in combination with a business card holder.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
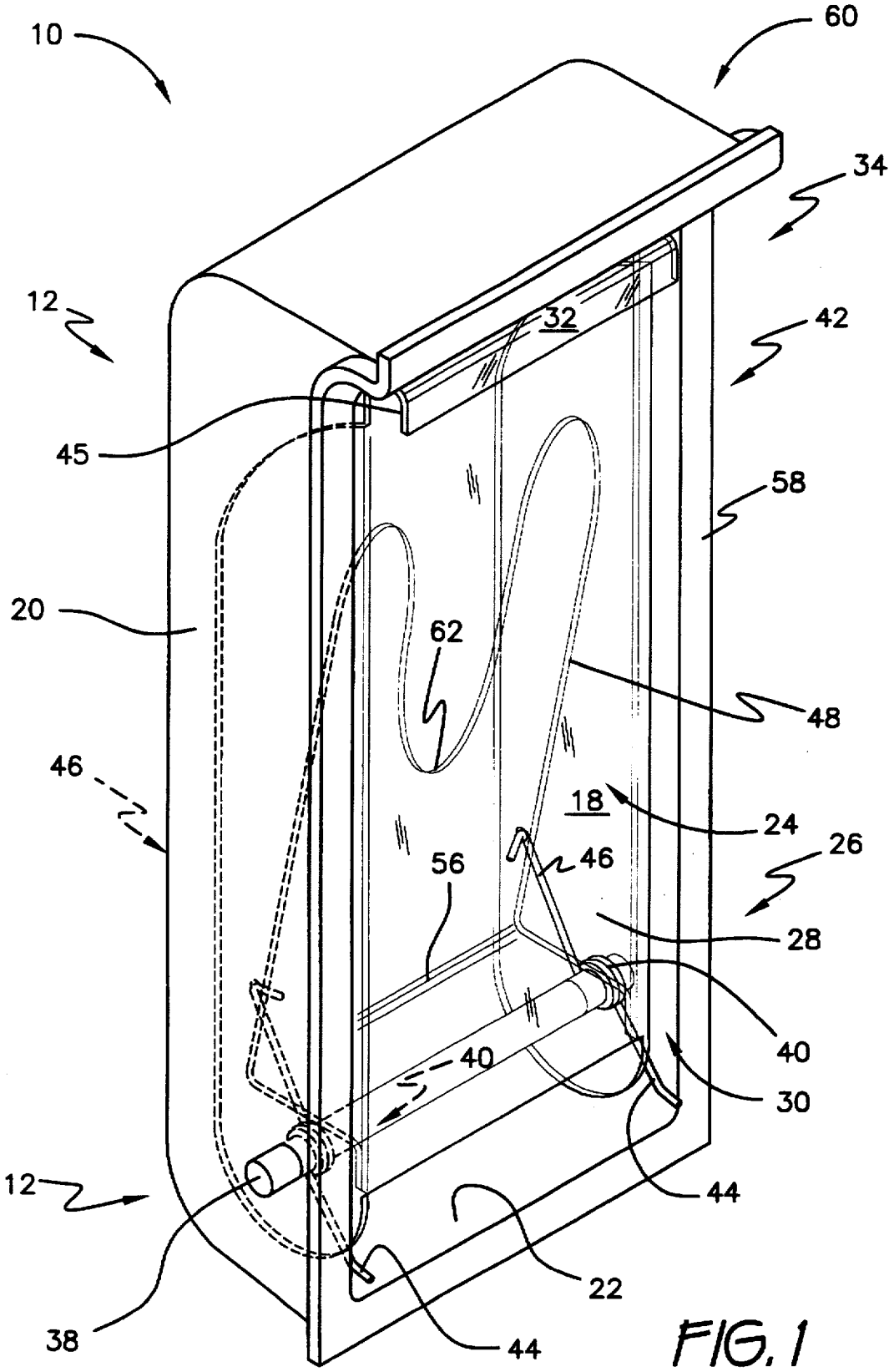
FIG. 1 is a perspective view of the invention.

Turning now to FIG. 1 of the drawings, display 10 is seen to comprise a housing 12 having a top wall 14, a rear wall 16, right and left lateral walls 18, 20, and a bottom wall 22, there being an opening 24 opening to the front of housing 12.

Opening 24 is closed by a transparent door 26 comprising a generally planar principal member 28 having a proximal end 30 and a forwardly turned handle 32 disposed at the distal end 34 of door 26. Transparency of door 26 assures that the nature of brochures 2 (see FIG. 3) being displayed within display 10 may be ascertained without opening door 26. Door 26 is pivotally mounted to housing 12 by a hinge 36 comprising a pivot pin 38 journaled within right and left lateral walls 18, 20 and springs 40. Two springs 40 formed as mirror images to one another are provided to assure that force is symmetrically imposed upon door 26, although the number and nature of springs 40 could be varied to as desired.

Hinge 36 is located at a proximal end of principal panel 28 of door 26, proximate bottom wall 22, so that door 26 will swing downwardly from the top when pulled open. This arrangement constrains brochures 2 (see FIG. 3) by gravity and by structure of door 26 against escaping when door 26 is swung downwardly when being opened. Handle 32 is located at the distal end 34 of panel 28, so that appropriate opening of door 26 is instinctively and intuitively recognized. Handle 32 can be readily grasped by curling the fingers (not shown) upwardly and inserting the fingers into recess 45 formed by handle 32. No actual closing of the fingers over any part of handle 32 or grasping is required. This characteristic affords a convenience which exerts an almost subconscious appeal to a potential reader of literature (see FIG. 2) contained within display 10.

Door 26 is shown in the closed position in FIG. 1, urged into this position by the action of springs 40, each of which is coiled around pivot pin 38. Each spring 40 has a first arm 44 and a second arm 46. Arm 44 braces its associated spring 40 against bottom wall 22 of housing 12, and arm 46 braces spring 40 against door 26. Preferably, door 26 is molded from a resilient or elastic material to include a pocket 42 pivotally carried within housing 12 at the rear side of principal member 28 of door 26 in a position proximate door 26. Alternatively stated, pocket 42 is disposed between door 26 and rear wall 16 of housing 12.

Contact of spring arms 46 with door 26 is made with a rear panel 48 of pocket 42. This arrangement enables springs 40 to perform two functions. One function is to urge door 26 into the closed position. The second function is to urge rear panel 48 to abut principal member 28 of door 26.

Figures 2, 3:
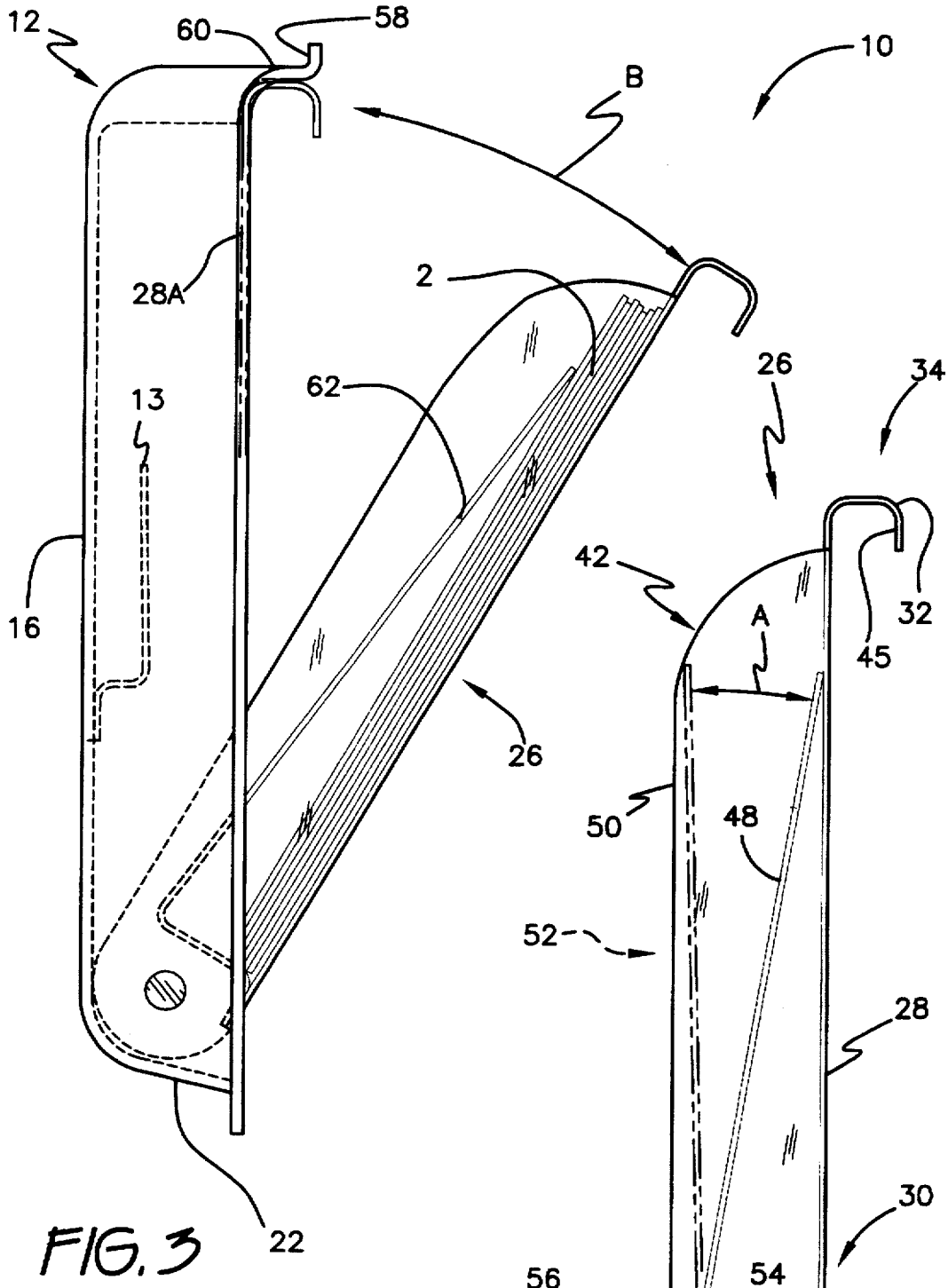
FIG. 2 is a side elevational detail view of the door and pocket formed integrally with the door.
FIG. 3 is an environmental, side elevational view of the invention, showing swing of the door as it opens.

Construction of pocket 42 is clearly shown in FIG. 2, wherein door 26 is shown isolated from housing 12. Pocket 42 comprises a left side pocket wall 50, a right side pocket wall 52 (concealed behind wall 50 in the view of FIG. 2), and a pocket floor member 54. Left and right side pocket walls 50, 52 are solidly fixed to principal panel 28, and project to the rear, or towards 16 when installed in housing 12. In turn, principal panel 28 is joined to pocket floor member 54 at the front edge of pocket floor member 54. Rear panel 48 of pocket 42 is joined to pocket floor member 54 at the rear edge of pocket floor member 54.

Due to elasticity of the constituent material, a resilient joint 56 is formed at the juncture of rear panel 48 and pocket floor member 54. Elasticity holds rear panel 48 in a position abutting front panel 28, thereby pinching brochures 2 (see FIG. 3) which are stored within pocket 42. Rear panel 48 may be pivoted away from principal panel 28, as indicated by arrow A, to enable brochures 2 to be loaded into pocket 42.

FIG. 1 also shows an outwardly projecting flange 58 extending along the entirety of opening 24 of housing 12. A drip hood 60 is formed at the top of housing 12 between flange 58 and top wall 14.

A relief 62 is formed in principal panel 28 of door 26 so that brochures 2 will be readily accessible to the fingers of a person wishing to withdraw a brochure 2.

FIG. 3 illustrates the open position of door 26, the swing of opening of door 26 being indicated by arrow B. Door 26 is mounted within housing 12 such that principal panel 28 of door 26 is contained within the confines of the interior of housing 12, whereby door 26, and especially brochures 2, are protected from exposure to rain. Containment of door 26 within the confines of the interior of housing 12 is illustrated by the position of the principal panel shown in broken lines in this Figure and designated by 28A.

FIG. 3 also shows that bottom wall 22 of housing 12 inclines downwardly from rear wall 16 to the front of housing 12, the front being that side having flange 58. Inclination of bottom wall 22 promotes drainage of water (not shown) from the interior of housing 12. Rear wall 16 may have a holder for business cards 13. Alternately, business card holder 13 can be attached to rear panel 48.

Thus it will be seen that a display 10 having a housing 12, a door 26, and a pocket 42 for holding brochures is advantageously fabricated primarily from two principal components. In particular, door 26 and pocket 42 are formed as a single or integral member which is capable of providing each component (door 26 or pocket 42) individually while simultaneously providing an elastic joint yielding joining rear panel 48 to pocket floor member 54 and urging the rear panel 48 into abutment with principal panel 28 of door 26.

The present invention is susceptible to variations and modifications which may be introduced without departing from the inventive concept. For example, pivot pin 38 could be provided with trunnions (not shown) formed integrally with housing 12 or fixed to housing 12 after assembly, if desired. In other examples, walls of housing 12 need not generally form a parallelepiped, and need not parallel and perpendicular to one another.

It is to be understood that the present invention is not limited to the embodiments described above, but encompasses any and all embodiments within the scope of the following claims.

I claim:

1. A display for storing and displaying promotional literature, comprising:

a housing having a top wall, a rear wall, lateral side walls, and a bottom wall, and an opening at the front of said housing;

a door comprising a generally planar principal member having a proximal end and a distal end, and a hinge disposed at said proximal end of said generally planar principal member to mount said door pivotally to said housing to move between a closed position and an open position, said hinge having a spring disposed to urge said door into said closed position; and a pocket pivotally carried within said housing, said pocket having a rear panel, and where said pocket is disposed between said door and said rear wall of said housing in a position proximate said door, said spring being disposed to urge said pocket to abut said door.

2. The display according to claim 1, said pocket comprising a right side pocket wall, a left side pocket wall, and a pocket floor member all fixed to the rear side of said principal member of said door.

3. The display according to claim 2, said pocket and said door formed integrally from a single member, said generally planar principal member of said door joined to said pocket floor member at the front edge of said pocket floor and said rear panel of said pocket joined to said pocket floor member at the rear edge of said pocket floor member, said pocket and said door formed from a resilient material providing an elastic joint yieldingly joining said rear panel of said pocket to said pocket floor member.

4. The display according to claim 1, said door having a forwardly turned handle fixed to said distal end of said door.

5. The display according to claim 4, said hinge being located proximate said bottom wall such that said door swings downwardly from said top wall when opened, whereby brochures contained within said display are constrained by gravity and by said door against escaping when said door is opened.

6. The display according to claim 1, said housing including an outwardly projecting flange extending along the entirety of said opening.

7. The display according to claim 1, said housing including a drip hood.

8. The display according to claim 1, said bottom wall of said housing inclining downwardly from said rear wall to the front of said housing, whereby drainage of water from the interior of said housing is promoted.

9. The display according to claim 1, said door mounted within said housing such that said generally planar principal member of said door is contained within the confines of the interior of said housing, whereby said door is protected from exposure to rain.

10. The display according to claim 1, said door being transparent, whereby the nature of brochures being displayed within said display may be ascertained without opening said door.

11. A display for storing and displaying promotional literature, comprising:

a housing having a top wall, a rear wall, lateral side walls, and a bottom wall, and an opening at the front of said housing, said bottom wall of said housing inclining downwardly from said rear wall to the front of said housing, whereby drainage of water from the interior of said housing is promoted, said housing including a drip hood formed at said top wall and an outwardly projecting flange extending along the entirety of said opening; and a door comprising a generally planar principal member having a proximal end and a distal end, and a hinge disposed at said proximal end of said generally planar principal member to mount said door pivotally to said housing to move between a closed position and an open position, said hinge having a spring disposed to urge said door into said closed position, said door having a forwardly turned handle fixed to said distal end of said door, said hinge being located proximate said bottom wall such that said door swings downwardly from said top wall when opened, whereby brochures contained within said display are constrained by gravity and by said door against escaping when said door is opened, said door being transparent, whereby the nature of brochures being displayed within said display may be ascertained without opening said door, and said door mounted within said housing such that said generally planar principal member of said door is contained within the confines of the interior of said housing, whereby said door is protected from exposure to rain, said door forming a pocket pivotally carried within said housing, said pocket having a rear panel, said pocket disposed between said door and said rear wall of said housing in a position proximate said door, said spring disposed to urge said rear panel of said pocket to abut said door, where said pocket further comprises a right side pocket wall, a left side pocket wall, and a pocket floor member all fixed to the rear side of said principal member of said door, and said pocket and said door formed integrally from a single member, said generally planar principal member of said door joined to said pocket floor member at the front edge of said pocket floor member and said rear panel of said pocket joined to said pocket floor member at the rear edge of said pocket floor, said pocket and said door formed from a resilient material providing an elastic joint yieldingly joining said rear panel of said pocket to said pocket floor member.

* * * * *